US005649830A

United States Patent [19]

Ellsom et al.

[11] Patent Number: 5,649,830

[45] Date of Patent: Jul. 22, 1997

[54] IGNITION LEAD ASSEMBLY FOR SPARK PLUG INTERNAL COMBUSTION ENGINE

[75] Inventors: Leslie Phillip Ellsom, Nr Studley; Martin Barrie Tillsley, Redditch, both of England

[73] Assignee: Lemark Auto Accessories Limited, Worcestershire, England

[21] Appl. No.: 535,093

[22] PCT Filed: Apr. 8, 1994

[86] PCT No.: PCT/GB94/00751

§ 371 Date: Oct. 18, 1995

§ 102(e) Date: Oct. 18, 1995

[87] PCT Pub. No.: WO94/27347

PCT Pub. Date: Nov. 24, 1995

[30] Foreign Application Priority Data

May 6, 1993 [GB] United Kingdom ..... 9309364

[51] Int. Cl.[6] ..... H01R 13/44

[52] U.S. Cl. ..... 439/128; 439/127

[58] Field of Search ..... 439/128, 125, 439/127

[56] References Cited

U.S. PATENT DOCUMENTS 5,178,550 1/1993 Fusselman et al. ..... 439/128

FOREIGN PATENT DOCUMENTS 2596589 10/1987 France .
WO8604480 8/1986 WIPO .

*Primary Examiner*—Neil Abrams
*Assistant Examiner*—T. C. Patel
*Attorney, Agent, or Firm*—Arnold B. Silverman; Alan G. Towner; Eckert Seamans Cherin & Mellott, LLC

[57] ABSTRACT

A boot on an ignition lead is gripped by a holder which is received in a tubular stem. The position of the holder relative to the stem can be adjusted to adapt the assembly for use in different engines.

20 Claims, 5 Drawing Sheets

IGNITION LEAD ASSEMBLY FOR SPARK PLUG INTERNAL COMBUSTION ENGINE

BACKGROUND INFORMATION

The present invention relates to ignition leads used in spark-ignition, internal combustion engines. There are now common engines in which access to the spark plugs is severely restricted. In a typical example, each spark plug is seated at the bottom of a well defined by other components of the engine. This gives rise to some difficulty in the removal of and replacement of ignition leads connected with the spark plugs of some engines To overcome this problem, some new vehicles are fitted by the vehicle assembler with a substantially rigid carrier for each spark plug lead. The carrier includes a lower portion for gripping an elastomeric boot associated with the ignition lead and an upper portion adapted to serve as a handle. The handle facilitates manipulation of the boot, which contains a termination of the ignition lead, to engage the termination with and disengage the termination from a terminal of the spark plug.

The length of rigid carrier required differs from one engine to another. It is therefore necessary for a variety of rigid carriers to be manufactured and for an appropriate carrier for use in conjunction with a particular engine to be selected. In a case where a skilled person selects and installs the rigid carrier with a replacement ignition lead, the known carriers may be satisfactory. However, in cases where the person who selects the carrier is unskilled, the existence of a variety of carriers, differing in respect of their lengths, is likely to lead to difficulties for example the selection and purchase of a rigid carrier which is unsuitable for the particular engine with which the replacement carrier and ignition lead are to be used.

SUMMARY OF THE INVENTION

According to a first aspect of the present invention, there is provided in or for a spark ignition internal combustion engine having a spark plug, an ignition lead connected with the plug and a boot covering a connection between the lead and the plug, a carrier for the boot which carrier comprises a stem and a hollow holder for the boot, the holder and the stem having respective interfitting formations which releasably retain the holder in a selected one of a plurality of alternative positions relative to the stem.

By selecting an appropriate position of the holder relative to the stem, the carrier can be adjusted for use in conjunction with a variety of engines.

In the preferred carrier the stem is hollow, the holder comprises at least two components, each of which extends around only a part of the circumference of the boot, and at least a part of the holder is embraced by the stem so that the stem retains said components in assembled relation with the boot.

According to a second aspect of the invention, there is provided a method of connecting m a spark plug of an internal combustion engine an ignition lead having a termination for engaging a terminal of the plug, wherein there is provided a holder for the termination and an elongate stem, the holder is assembled with the termination, the holder is assembled with the stem and is adjusted to a selected position along the stem and wherein the stem is used as a handle during application of the termination to the plug.

Preferably, when the holder has been adjusted to a selected position along the stem, a projection on one of the holder and the stem snaps into an opening in the other of the holder and the stem m retain the holder in the selected position relative to the stem.

There is also provided in accordance with the invention a set of components for use in a method according to the second aspect, the set comprising first and second components adapted to be assembled with each other to form a holder and a hollow stem adapted to receive a portion of the lead and to receive a portion of the holder the stem and at least one of said first and second components having respective formation, for co-operation to releasably restrain movement of the holder relative to the stem.

An example of an assembly embodying he first aspect of the invention and of a method embodying the second aspect of the invention will now be described with reference to the accompanying drawings, wherein:

DETAILED DESCRIPTION OF THE PREFERRED EMBODIMENT

Figure 1:
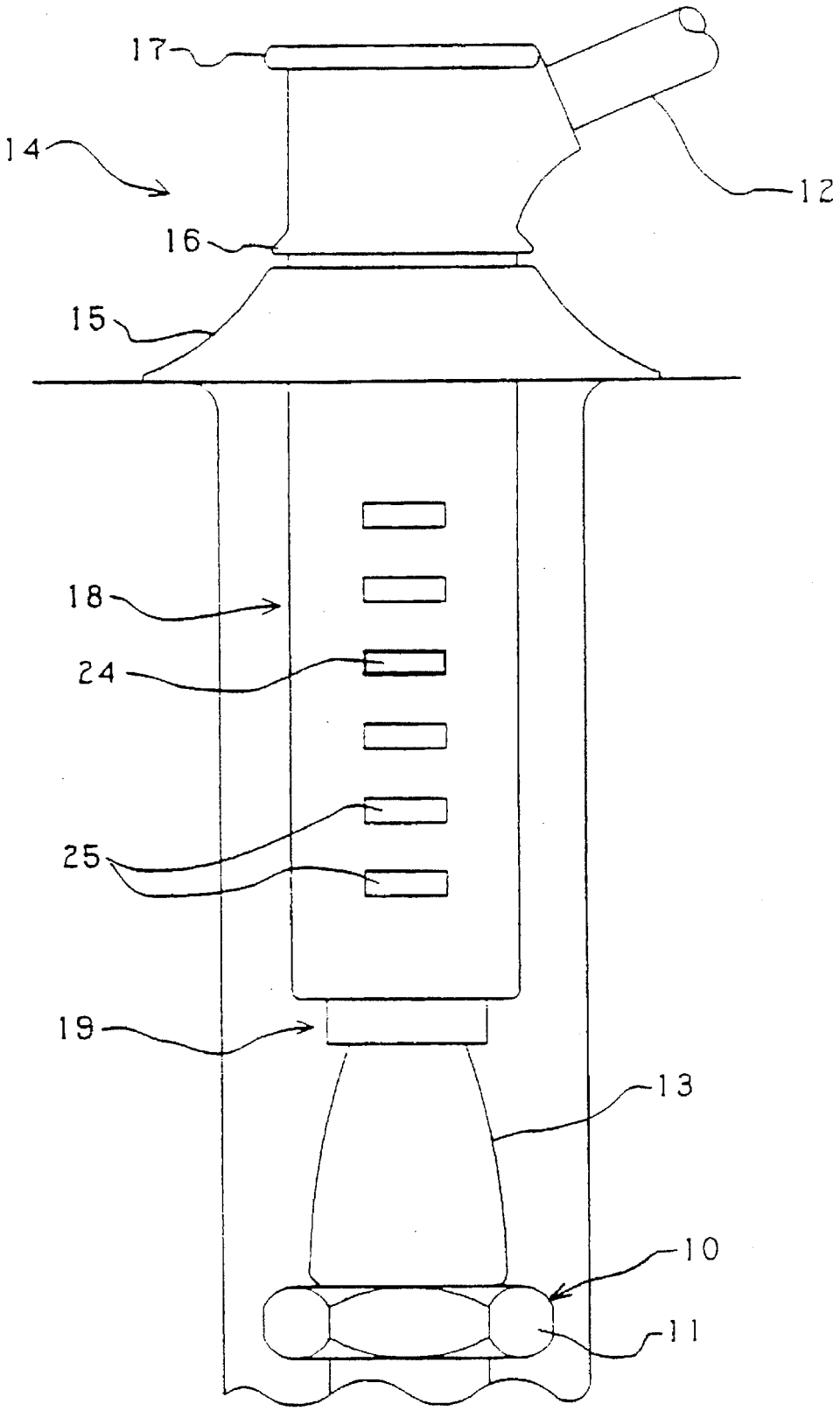
FIG. 1 shows diagrammatically an elevation of a part of a spark plug of an internal combustion engine a part of an ignition lead connected with the plug, a part of a boot which covers a connection between the lead and the plug and a carrier for the boot.
Figure 2:
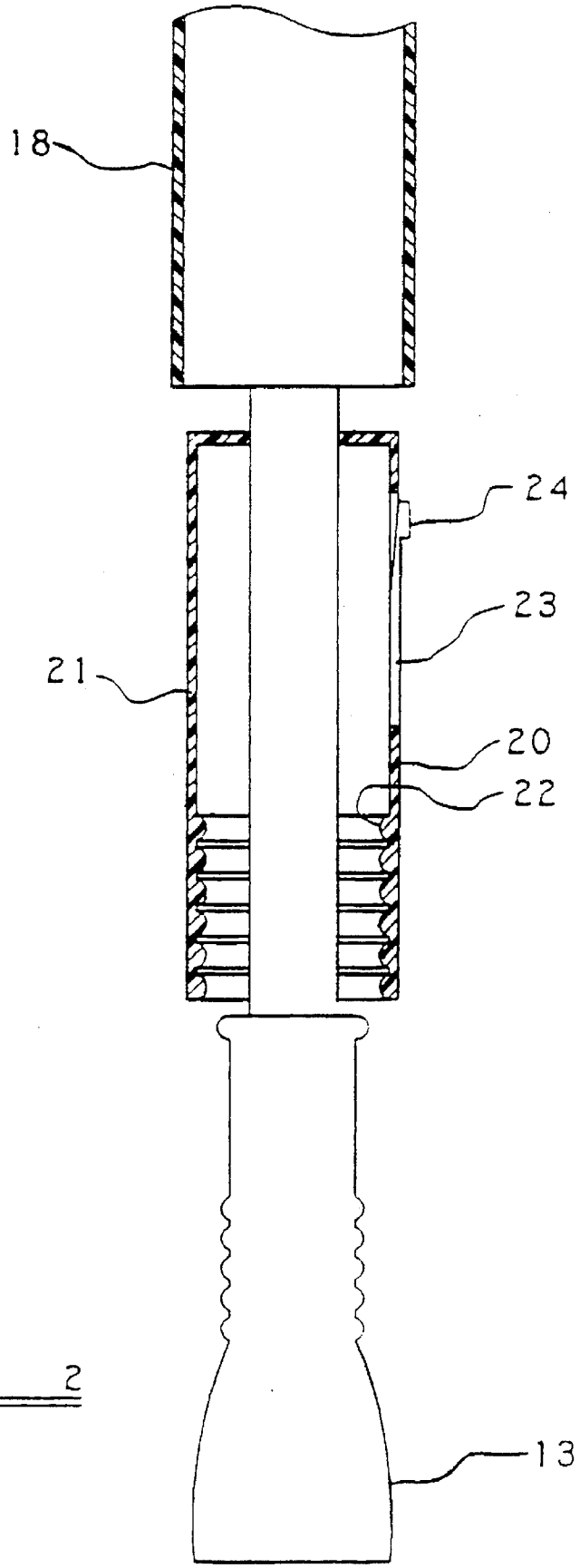
FIG. 2 shows certain of the parts of FIG. 1 disassembled from one another.
Figure 3:
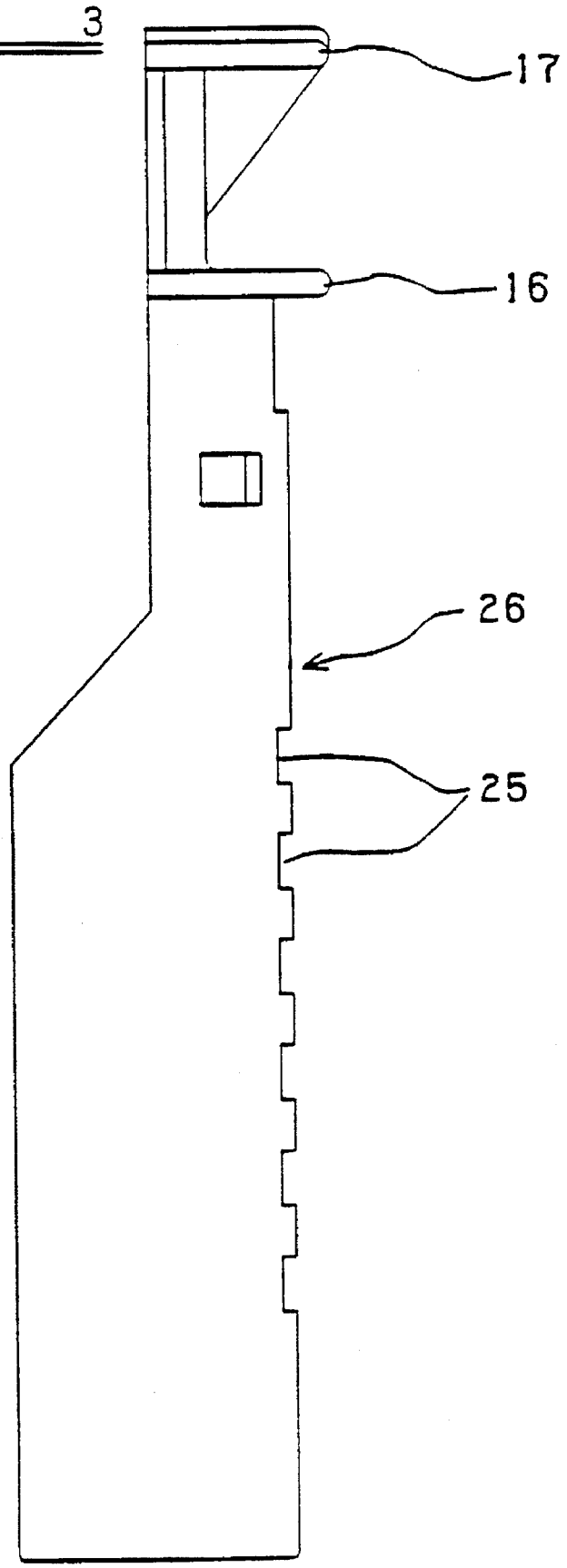
FIG. 3 shows a stem component of the assembly of FIG. 1.
Figure 4:
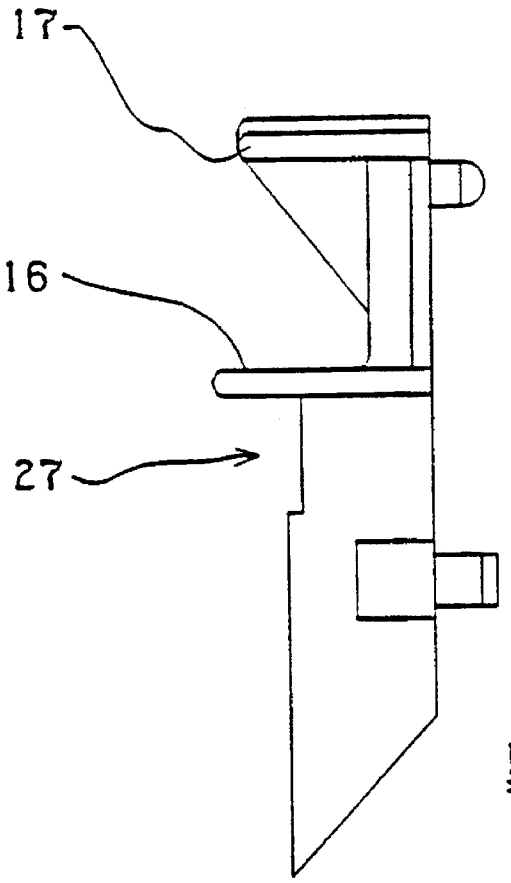
FIG. 4 shows a further stem component of the assembly.
Figure 5:
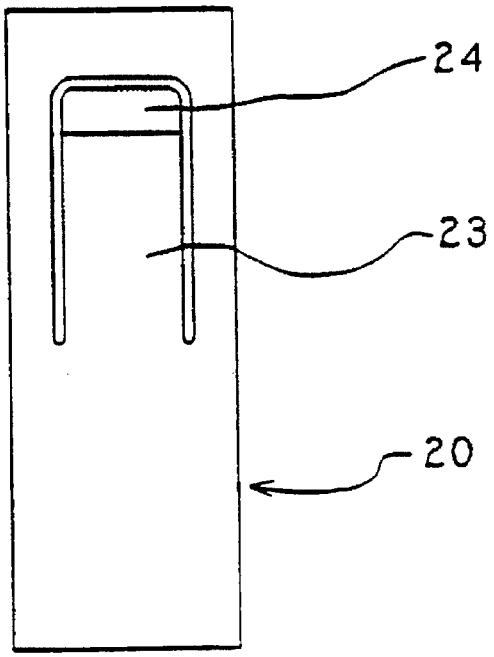
FIG. 5 shows a holder component of the assembly.

In FIG. 1, there is shown a part of a spark plug 10 of a spark-ignition, internal combustion engine. The engine, including the spark plug, may be constructed and arranged in a known manner. The spark plug includes flats 11 for co-operation with a spanner used to screw the spark plug into and to withdraw the spark plug from a threaded bore in a cylinder head of the engine. At its end remote from the interior of the engine, the spark plug has an electrical terminal (not shown) of known form.

An ignition lead 12 is connected electrically with the terminal of the spark plug 10. The lead includes at one end a known termination for co-operation with the terminal. The connection between the lead and the terminal is covered by a boot 13 which also may be of known form. The boot embraces a part of the lead 12 adjacent to the termination and also embraces a part of the spark plug which lies between the terminal of the plug and the flats 11. The boot is typically formed of an elastomeric composition and prevents the spark plug terminal and termination of the ignition lead from becoming contaminated by water or other foreign matter.

There is fitted on the boot 13 a hollow carrier 14 for the boot. At least an upper end portion of the boot is received in a lower end portion of the carrier 14. On the outside of the carrier there is an elastomeric seal 15 of annular form for bearing on an external part of the engine and sealing a gap between the carrier 14 and the engine. The carrier has a circumferential rib 16 for engaging the seal 15 to limit movement of the seal relative to the carrier in a direction away from the plug 10. At its upper end, the carrier 14 has an outwardly protruding lip 17 which adapts the upper end portion of the carrier to serve as a handle when the carrier 14, ignition lead 12 and boot 13 as an assembly, are fitted to and withdrawn from the plug 10.

The carrier 14 comprises an elongate stem 18 which extends along at least a major part of the length of the carrier. The stem is hollow and has an opening at its lower end and at Least one further opening adjacent to its upper end. The interior of the carrier receives a part of the lead 12 and the lead emerges from the interior or the carrier through the opening adjacent to the upper end of the carrier.

The carrier 14 further comprises a hollow holder 19 for the boot 13. The holder has the form of a generally cylindrical tube, has a wider opening at its lower end and a narrower opening at its upper end. A lower portion of the holder 19 is formed with internal ribs 22 for gripping the boot 13. The holder grips the boot 13 at least in that region of the boot which embraces the termination of the ignition lead 12. The boot does not extend to the upper end of the holder 19. The opening at that end of the holder has a diameter corresponding to the diameter of the lead 12 and the lead leaves the holder 19 through that opening.

The holder 19 is a sliding fit in a lower end portion of the stem 18. At least a part of the holder and in some instances, the entire holder, lies inside the stem.

The holder 19 defines a tongue 23 which is elongated and is arranged with its length extending along the length of the holder 19. At one of its ends the tongue merges with the remainder of the holder. The opposite end of the tongue is a free end and bears a radial projection 24. It the stem 18, there is formed a row of openings 25. Each of these has a size such that at can receive with sliding clearance the radial projection 24 on the tongue 23. The holder 19 is formed of a resiliently deformable plastics material. The tongue 23 can flex resiliently to permit the projection 24 to enter the stem 18 and to move along the interior of the stem to the lowermost of the openings 25. If aligned with this opening, the projection 24 will snap into the opening, thereby restraining further longitudinal movement of the holder 19 relative to the stem 18. If the projection 24 is depressed out of the lowermost opening 25 the holder can be moved further into the stem to align the projection 24 with a selected one of the openings 25 and allow the projection to snap into that opening. The holder 19 can be moved to a selected one of several alternative positions inside the stem 18 and releasably retained in that position by engagement of the projection 24 in a corresponding one of the openings 25. When the projection 24 lies in the uppermost of the openings 25, the holder 19 is disposed entirely inside the stem 18. When the projection is engaged in the lowermost of the openings 25, a lower part of the holder 19 protrudes from the stem.

It will he noted that when the projection 24 occupies one of the openings 25, it is accessible from the outside of the stem 18 and can readily be depressed from that opening.

The stem 18 comprises a first component 26 and a second component 27 which are formed separately from each other end are assembled together after the ignition lead 12 has been introduced into the first component. The first component 26 has a length equal to that of the stem 18 and includes a lower portion which is of hollow, generally cylindrical form. An upper end portion of the component 26 defines a recess for receiving the component 27. These components collectively define the aperture at the upper end of the stem 18, through which the lead 12 emerges. The component 27 is a snap-fit on the component 26.

The components 26 and 27 of the stem 18 are formed as mouldings of a plastics composition. The assembled stem is substantially rigid. The carrier 19 also may be a single moulding of a plastics material.

An ignition lead 12 which is to be connected with the plug 10, the lead bearing the boot 13, is introduced into the component 26 of the stem 18 until the termination of the lead and the boot 13 protrude from a lower end of the component 26 whilst a part of the lead 12 protrudes beyond the upper end of the component. There may also be present on that part of the lead which lies inside the component 26 a further, annular seal or spacer which surrounds the lead.

The boot 13 and holder 19 are positioned on the lead 12 before stem 18 receives the lead and possibly before the terminations are applied to the lead. The holder is pushed onto the boot to establish an interference fit of the holder on the boot. The holder 19 is moved along the interior of the stem 18 to the required position and the projection 24 is then permitted to snap into an appropriate one of the openings 25. This secures the holder against longitudinal movement relative to the stem. The stem component 27 is then applied to the component 26 substantially to close the upper end of the stem. The components 26 and 27 collectively embrace the lead 12 at the position where that lead emerges from the stem.

The user grasps the lip 17 and adjacent parts of the stem 18 and moves the assembly longitudinally onto the plug 10. The termination of the lead 12 is pushed onto the terminal of the plug and the boot 13 is pushed onto an insulator of the plug, the necessary axially directed forces being transmitted from the user via the stem 18, the projection 24 and the ribs 22 to the boot 13.

Tensile force also can be transmitted from the user to the boot 13 along the same path. Thus, the user can draw the boot 13 and the lead 12 from the plug 10.

The lead 12, boot 13 and the carrier components 19, 26 and 27 may be supplied as a kit in a single package which can be used to provide an ignition lead in a variety of situations.

Figure 6:
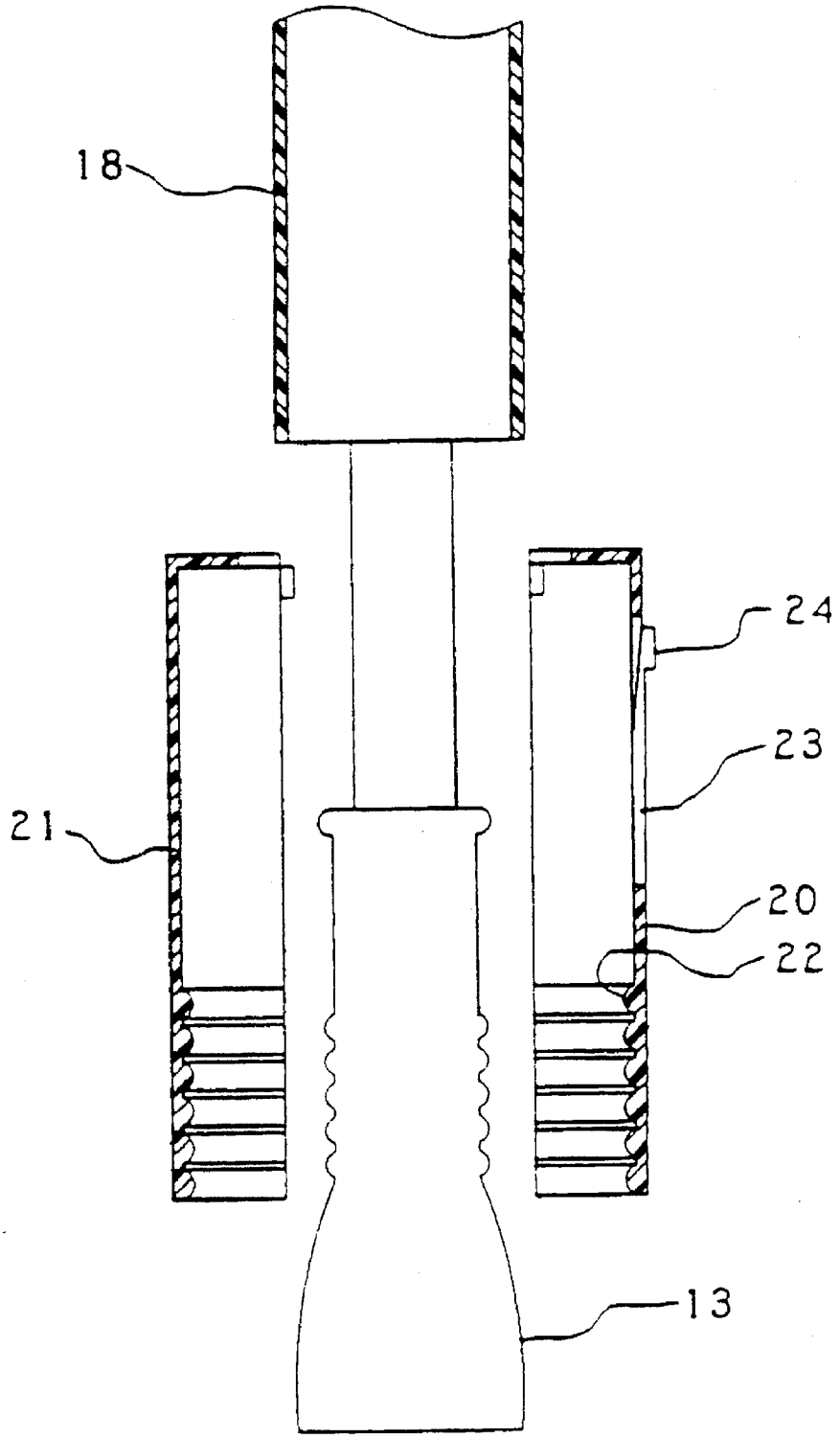
FIG. 6 illustrates a modification of the assembly FIGS. 1 to 5.

As shown in FIG. 6, the holder 19 may be formed in two components 20, 21 each of which is of generally semi-cylindrical form and extends along the entire length or the holder 19. In the component 20 there are formed recesses and lugs are formed on the component 21 to enter the recesses and locate the components 20 and 21 relative to each other.

It will be understood that, in this modified structure one half of each rib 22 is formed on the component 20 and the other half of that rib on the component 21. The tongue 23 is incorporated in the component 20. During assembly of the modified structure, the components 20 and 21 of the holder 19 are assembled around the boot 13 and this assembly is then inserted into the lower end portion of the stem 18. The stem retains the holder components 20 and 21 in assembled relation with each other and with the boot and these components grip the boot to restrain the boot against longitudinal movement relative to the holder.

The features disclosed in the foregoing description, or the following claims, or the accompanying drawings, expressed in their specific forms or in terms of a means for performing the disclosed function or a method or process for attaining the disclosed result, as appropriate, may, separately or in any combination of such features, be utilised for realising the invention in diverse forms thereof.

We claim:

1. An ignition lead assembly for a spark ignition internal combustion engine comprising a spark plug, an ignition lead connected with the plug, a boot covering a connection between the lead and the plug, and a carrier for the boot, the carrier comprising an elongated stem and a hollow holder for the boot, the holder and the stem having respective interfitting formations which releasably retain the holder in a selected one of a plurality of alternative positions along the length of the stem.

2. The ignition lead assembly according to claim 1 wherein the interfitting formations provide for adjustment of the holder along the stem.

3. The ignition lead assembly according to claim 1 wherein said formations include a projection on one of the holder and the stem and a row of openings in the other of the holder and the stem for receiving a projection.

4. The ignition lead assembly according to claim 3 wherein the projection is on a flexible tongue.

5. The ignition lead assembly according to claim 1 wherein the holder comprises at least two components, each of which extends around only a part of the circumference of the boot.

6. The ignition lead assembly according to claim 5 wherein one of said components is substantially semi-cylindrical and the other has a form which is substantially that of a semi-cylinder with the radial projection.

7. The ignition lead assembly according to claim 1 wherein the holder has a form which is substantially that of a cylinder with a radial projection.

8. The ignition lead assembly according to claim 7 wherein the stem is hollow and at least a part of the holder is embraced by the stem so that the stem retains said components in assembled relation with the boot.

9. The ignition lead assembly according to claim 1 wherein the stem comprises at least first and second components, the first component extends along substantially the entire length of the stem and the second component fits in a recess defined by the first component adjacent to one end of the first component.

10. The ignition lead assembly according to claim 9 wherein the second component of the stem is a snap-fit on the first component of the stem.

11. The ignition lead assembly according to claim 9 wherein the first and second components of the stem collectively embrace the lead.

12. A method for connecting to a spark plug of an internal combustion engine an ignition lead having a termination for engaging a terminal of the plug comprising providing a holder for the termination and an elongate stem, assembling the holder with the termination, assembling the holder with the stem and adjusting it to a selected position along the length of the stem and employing the stem as a handle during application of the termination to the plug.

13. A method according to claim 12 wherein the stem is hollow and the ignition lead is inserted along the interior of the stem.

14. A method according to claim 12 wherein, when the holder has been adjusted to the selected position along the stem, a projection on one of the holder and the stem snaps into an opening in the other to retain the holder in the selected position relative to the stem.

15. A set of components for use in creating an assembly in accordance with the method as defined in claim 12, the set comprising first and second components adapted to be assembled with each other to form a holder and hollow stem adapted to receive a portion of the lead and to receive a portion of the holder, the stem and at least one of said first and second components having respective formations for cooperation to releasably restrain movement of the holder relative to the stem.

16. A method according to claim 12 including assembling the holder from a pair of components.

17. A method according to claim 16 including fitting a boot to the lead adjacent to said termination to cover the termination and wherein the assembled holder embraces a part of the boot.

18. An ignition lead assembly for a spark ignition internal combustion engine comprising a spark plug, an ignition lead connected with the plug, a boot covering a connection between the lead and the plug, and a carrier for the boot, the carrier comprising a stem and a hollow holder for the boot, the holder and the stem having respective interfitting formations which releasably retain the holder in a selected one of a plurality of alternative positions relative to the stem, wherein said formations include a projection on one of the holder and the stem and a row of openings in the other of the holder and the stem for receiving the projection, said projection being on a flexible tongue.

19. An ignition lead assembly for a spark ignition internal combustion engine comprising a spark plug, an ignition lead connected with the plug, a boot covering a connection between the lead and the plug, and a carrier for the boot, the carrier comprising a stem and a substantially cylindrical hollow holder for the boot, the holder and the stem having respective interfitting formations which releasably retain the holder in a selected one of a plurality of alternative positions relative to the stem, wherein the stem is hollow and at least a part of the holder is embraced by the stem.

20. An ignition lead assembly for a spark ignition internal combustion engine comprising a spark plug, an ignition lead connected with the plug, a boot covering a connection between the lead and the plug, and a carrier for the boot, the carrier comprising a stem and a hollow holder for the boot, the holder and the stem having respective interfitting formations which releasably retain the holder in a selected one of a plurality of alternative positions relative to the stem, wherein the stem comprises at least first and second components, the first component extends along substantially the entire length of the stem and the second component fits in a recess defined by the first component adjacent to one end of the first component.

* * * * *

UNITED STATES PATENT AND TRADEMARK OFFICE

CERTIFICATE OF CORRECTION

PATENT NO. : 5,649,830

DATED : July 22, 1997

INVENTOR(S) : Leslie Phillip Ellsom and Martin Barrie Tillsley

It is certified that error appears in the above-identified patent and that said Letters Patent is hereby corrected as shown below:

Column 1, line 57, "m" should be --to--.

Column 2, line 1, "m" should be --to--.

Column 2, line 12, "the" should be --the--.

Column 2, line 52, "fiats" should be --flats--.

Column 3, line 28, "It" should be --In--.

Column 3, line 30, "at" should be --it--.

Column 3, line 57, "end" should be --and--.

Column 4, line 41, "or" should be --of--.

Signed and Sealed this

Twelfth Day of May, 1998

*Attest:*

*Attesting Officer*

BRUCE LEHMAN

*Commissioner of Patents and Trademarks*